United States Patent [19]

Mascia

[11] 4,190,956

[45] Mar. 4, 1980

[54] CAN OPENER

[75] Inventor: Carmen T. Mascia, Clarendon Hills, Ill.

[73] Assignee: The Continental Group, Inc., New York, N.Y.

[21] Appl. No.: 938,619

[22] Filed: Aug. 31, 1978

[51] Int. Cl.[2] ..... B67B 7/30

[52] U.S. Cl. ..... 30/410; 30/411; 30/442

[58] Field of Search ..... 30/410, 411, 435, 436, 30/442; 220/281, 306

[56] References Cited

U.S. PATENT DOCUMENTS

| | | | |
|---|---|---|---|
| 602,654 | 4/1898 | Cameron | 30/411 X |
| 1,048,202 | 12/1912 | Oberg | 30/435 X |
| 1,655,449 | 1/1928 | Werner | 30/435 |
| 2,546,467 | 3/1951 | McBride | 30/435 X |
| 3,307,256 | 3/1967 | Powers | 30/410 |
| 3,487,965 | 1/1970 | Gale | 30/410 X |

*Primary Examiner*—Gary L. Smith
*Attorney, Agent, or Firm*—Charles E. Brown

[57] ABSTRACT

An opener for removing an end panel portion of a container end unit. The opener includes a simple housing which may be molded of plastics material and which carries a blade for penetrating and severing the end panel along a preformed weakening line in the form of a score. There is also a magnet for retaining the severed end panel portion relative to the opener. Further, the housing has a separate skirt portion which is radially movable and which carries a ridge for underlying a double seam securing an end unit to a container body so as to lock the opener on the end unit once the blade has penetrated the end panel.

10 Claims, 5 Drawing Figures

FIG. 1
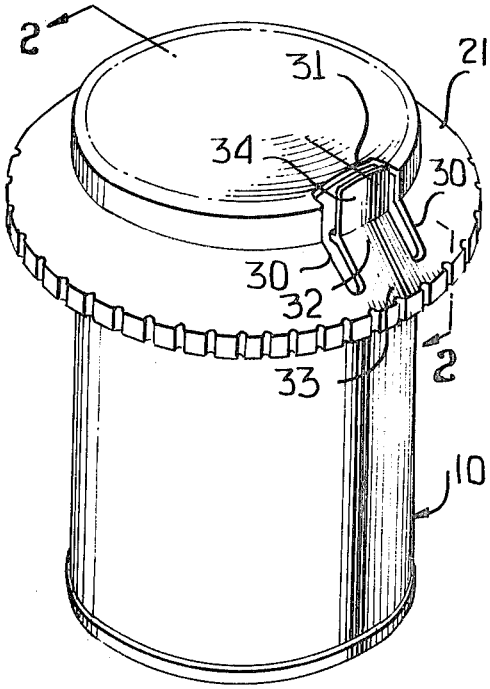
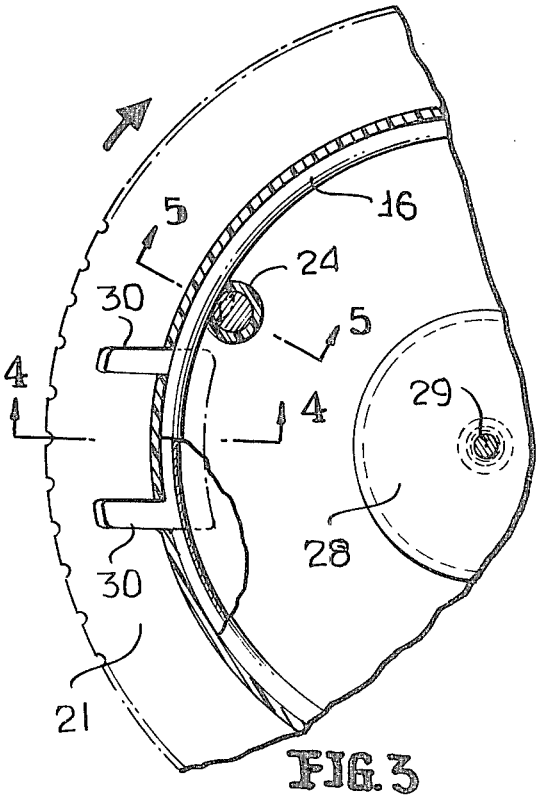
FIG. 3
FIG. 2
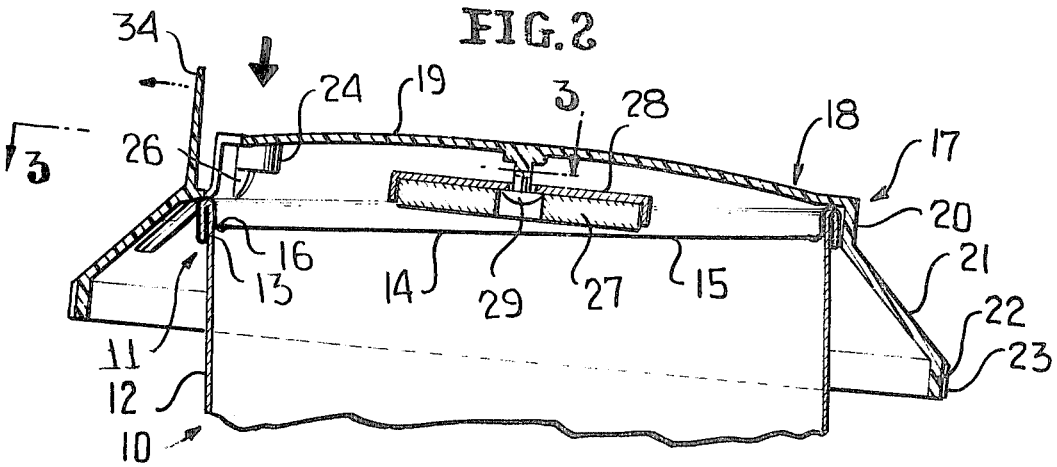
FIG. 4
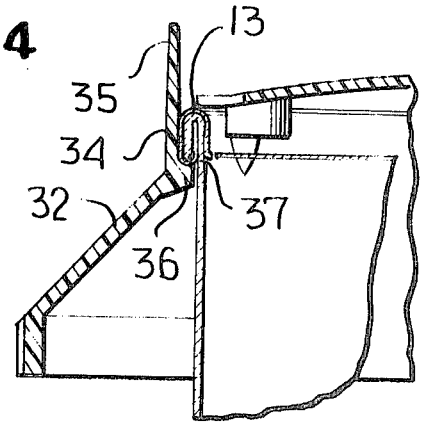
FIG. 5
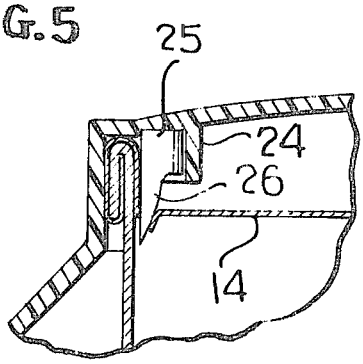

CAN OPENER

This invention relates in general to new and useful improvements in can openers, and more specifically to an opener which is particularly adapted for use in combination with cans having a preformed score on the end panel thereof.

Many types of can openers have been developed in the past. However, for the most part all presently available practical can openers are of the mechanical type which are somewhat complicated and are difficult to operate, except, of course, for electric can openers. This invention particularly relates to a simple can opener which may be advantageously utilized in conjunction with an end unit having a score line formed therein which defines a removable panel portion.

The can opener includes a simple housing which may be readily molded of plastics material, with the housing carrying a simple blade and a magnet. The housing is configurated automatically to align the blade with the preformed score and has a grip portion of relatively large diameter for facilitating the rotation thereof.

Most particularly, the housing has a skirt which cooperates with the customary double seam to align the housing with the container, and that skirt is interrupted and is resiliently carried by the housing for generally radial movement. The separated skirt portion has a ridge which is adapted to underlie the projecting seam and lock the housing on the can which is being opened. The separately formed skirt portion has a thumb engageable extension which is positioned for natural engagement with one's thumb during the gripping of the housing so as automatically to retain the ridge in underlying position with respect to an end unit seam.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a top perspective view of the opener applied to a can.

FIG. 2 is an enlarged fragmentary vertical sectional view taken generally along the line 2—2 of FIG. 1, and shows the opener in the process of being applied to the can.

FIG. 3 is an enlarged fragmentary generally horizontal sectional view taken along the line 3—3 of FIG. 2, and shows more specifically the details of the opener and the relationship thereof to the can.

FIG. 4 is an enlarged fragmentary vertical sectional view taken along the line 4—4 of FIG. 3, but with the opener fully applied to the can and shows the interlock of the opener beneath the double seam.

FIG. 5 is an enlarged fragmentary vertical sectional view taken along the line 5—5 of FIG. 3, with the opener fully applied to the can and the blade having penetrated the end panel.

This invention particularly relates to the opening of a conventional can, such as the can 10 illustrated in the drawings. The can 10 may be of a one-piece of two-piece construction and includes a top end unit, generally identified by the numeral 11, which is secured to a body 12 of the can 10 by means of a conventional double seam 13. The end unit 11 includes a customary end panel 14 which has a removable panel portion 15 defined by a circular score 16. The opener, which is the subject of this application, is generally identified by the numeral 17 and includes a housing or body generally identified by the numeral 18. The housing 18 may be of any construction, but is most economically molded of a suitable plastics material so as to be of a one-piece construction.

The housing 18 includes an end wall 19 having depending therefrom a peripheral skirt 20. The skirt 20 is generally cylindrical in outline and is of an internal size snugly to engage over the seam 13 so as accurately to align the housing 18 with the end unit 11.

The housing 18 also includes a frustoconical skirt extension 21 which depends from the skirt 20 and tapers upwardly and inwardly.

The housing 18 also includes a lowermost annular grip portion 22 which may have a corrugated outer surface 23 to facilitate the gripping of the housing 18 and thus rotate the opener 17 relative to the can 10.

It will be readily apparent from FIG. 2 that the skirt extension 21 facilitates the automatic alignment of the housing 18 with the can 10 and the telescoping of the skirt 20 over the double seam 13.

The underside of the end wall 19 has an integral fitment 24 in which there is mounted a shank portion 25 of a blade 26. The blade 26 is radially positioned for alignment with the score 16. The blade 26 has a sharpened point and further has sharpened side edges so that it may not only be utilized to penetrate the end panel 14, but also to cut and sever the end panel along the score line 16 when the opener 17 is rotated relative to the can 10.

In order to retain the removable panel portion 15 after it is severed for removal with the opener 17, there is provided a permanent magnet 27 which is preferably mounted within a casing 28 and which casing is retained against limited movement both axially and tilting with respect to the end wall 19 by a headed pin 29. It will be readily apparent that the magnet 28 will engage the removable panel portion 15 at such time as the opener 17 is in fully seated position on the can so that the tension of the removable panel portion 15 is assured.

The opener 17, as described, will function adequately. However, a further feature of the opener is that the skirt 20 is interrupted by a pair of slots 30 which also extend down into the skirt extension 21. The slots 30 terminate at their upper ends in a relatively large opening 31 in the end wall 19. The slots 30 define a skirt extension portion 32 which is integrally connected to the remainder of the skirt extension 21 along a bend line 33.

The skirt extension portion 32 carries a skirt portion 34 separately formed from the remainder of the skirt 20. The skirt portion 34 has an upper extension 35 so that the combined height of the skirt portion 34 and and the extension 35 is such as to be readily engageable by one's thumb when gripping the grip portion 22 for the purpose of rotating the opener 17.

The skirt portion 34 carries a radially inwardly directed projection 36 at its intersection with the skirt extension portion 32 with the projection 36 defining an upwardly facing ridge 37.

As is best shown in FIG. 2, the dimensions of the housing 18 are such that when the opener is applied to a can the projection 36 engages the upper surface of the double seam 13. As the opener is forced downwardly onto the can, the projection 36 will be cammed radially outwardly as is generally indicated by the horizontally directed arrow in FIG. 2. When the opener 17 is fully seated on the end unit 11, the projection 36, due to the resiliency of the skirt extension portion 32 and its connection to the skirt extension 21, will spring back to its original position and engage beneath the double seam 13.

Then, when the opener 17 is properly gripped, the skirt portion 34 will be constantly urged radially inwardly so as to hold the ledge 37 in engagement with the underside of the double seam 13 and retain the opener on the can.

It will be readily apparent that the opener 17 is of a simple construction so that it may be made at a minimum cost and at the same time, having no effective moving parts, it is simple to operate.

It is to be noted that the opening 31 is disposed immediately adjacent the blade 26. When the opener 17 is actuated by rotation in a clockwise direction as viewed in FIG. 3, the opening 31 immediately trails the blade and thus the opening operation can be observed through the opening 31.

Although only a preferred embodiment of the opener has been specifically illustrated and described herein, it is to be understood that minor variations may be made in the opener without departing from the spirit and scope of the invention as defined by the appended claims.

What is claimed as new is:

1. An opener for removing an end panel of a container end joined to a container body by a seam defining a peripheral projection, said opener comprising a housing of a generally inverted cup-shaped configuration and including an end wall and a depending annular skirt, said skirt being of an internal dimension to define guide means for telescoped engagement over a peripheral projection of an intended container size, a cutter depending from said end wall and projecting therebelow for penetrating and severing a container end panel, said skirt being interrupted and including a skirt portion resiliently mounted for radial movement and defining retaining means for movement into retaining engagement beneath a container peripheral projection, said skirt portion being disposed circumferentially adjacent said cutter.

2. The opener of claim 1 wherein said skirt portion is in trailing relation to said cutter with respect to the intended direction of rotation of said opener.

3. The opener of claim 1 wherein said retaining means is a lower radially inwardly directed ledge on said skirt for underlying a container peripheral projection and axially positioning said opener relative to a container during the opening thereof.

4. An opener for removing an end panel of a container end, said opener comprising a housing of a generally inverted cup-shaped configuration and including an end wall and a depending annular skirt, said skirt defining guide means for telescoped guided engagement over a container peripheral projection, a cutter depending from said end wall and projecting therebelow for penetrating and severing a container end panel, said skirt being interrupted and inlcuding a skirt portion resiliently mounted for radial movement into retaining engagement beneath a container peripheral projection, said skirt portion being disposed circumferentially adjacent said cutter, said skirt portion being in trailing relation to said cutter with respect to the intended direction of rotation of said opener, said end wall having an opening therein radially aligned with said skirt portion, said opening defining a viewing port for viewing the opening progress of a container.

5. An opener for removing an end panel of a container end, said opener comprising a housing of a generally inverted cup-shaped configuration and including an end wall and a depending annular skirt, said skirt defining guide means for telescoped guided engagement over a container peripheral projection, a cutter depending from said end wall and projecting therebelow for penetrating and severing a container end panel, said skirt being interrupted and including a skirt portion resiliently mounted for radial movement into retaining engagement beneath a container peripheral projection, said skirt portion being disposed circumferentially adjacent said cutter, said skirt portion extending axially above said end wall and defining external means for engaging said skirt portion and urging said skirt portion radially inwardly while gripping and rotating said opener.

6. An opener for removing an end panel of a container end, said opener comprising a housing of a generally inverted cup-shaped configuration and including an end wall and a depending annular skirt, said skirt defining guide means for telescoped guided engagement over a container peripheral projection, a cutter depending from said end wall and projecting therebelow for penetrating and severing a container end panel, said skirt being interrupted and including a skirt portion resiliently mounted for radial movement into retaining engagement beneath a container peripheral projection, said skirt portion being disposed circumferentially adjacent said cutter, said skirt having a frustoconical extension forming a guide for guiding said opener into position on a container to be opened, said skirt extension being interrupted and having a projecting portion carrying said skirt portion and forming mounting means therefor.

7. The opener of claim 6 wherein said frustoconical skirt extension terminates in a peripheral flange defining primary grip means for said opener.

8. The opener of claim 6 wherein said skirt portion adjacent its intersection with said skirt extension portion is provided with a radially inwardly directed ledge for underlying a container peripheral projection and axially positioning said opener relative to a container during the opening thereof.

9. An opener for removing an end panel of a container end joined to a container body by a seam defining a peripheral projection, said opener comprising a housing of a generally inverted cup-shaped configuration and including an end wall and a depending annular skirt, said skirt defining guide means for telescoped guided engagement over a container peripheral projection, a cutter depending from said end wall and projecting therebelow for penetrating and severing a container end panel, said skirt being interrupted and including a skirt portion resiliently mounted for radial movement and defining retaining means for movement into retaining engagement beneath a container peripheral projection, said skirt portion being disposed circumferentially adjacent said cutter.

10. The combination of a container and an opener, said container being of the type including a body having one end closed by a container end joined to said body by a seam defining a peripheral projection, said container end having an end panel, and said opener being means for removing said end panel and including a housing of a generally inverted cup-shaped configuration and including an end wall and a depending annular skirt, said skirt being in telescoped guided engagement over said peripheral projection, a cutter depending from said end wall and penetrating said end panel, said skirt being interrupted and including a skirt portion mounted for resiliently radially outwardly directed movement and in retaining engagement beneath said peripheral projection, said skirt portion being disposed circumferentially adjacent said cutter.

* * * * *